US010670260B1

(12) United States Patent
Wells

(10) Patent No.: US 10,670,260 B1
(45) Date of Patent: Jun. 2, 2020

(54) ILLUMINATED DOMINO TILE ASSEMBLY

(71) Applicant: Linzell Wells, N Las Vegas, NV (US)

(72) Inventor: Linzell Wells, N Las Vegas, NV (US)

( * ) Notice: Subject to any disclaimer, the term of this patent is extended or adjusted under 35 U.S.C. 154(b) by 0 days.

(21) Appl. No.: 16/451,950

(22) Filed: Jun. 25, 2019

(51) Int. Cl.

| | |
|---|---|
| ***F21V 33/00*** | (2006.01) |
| ***A63F 9/20*** | (2006.01) |
| ***F21L 4/08*** | (2006.01) |
| ***F21Y 115/10*** | (2016.01) |
| ***A63F 9/24*** | (2006.01) |

(52) U.S. Cl.
CPC ..... *F21V 33/008* (2013.01); *A63F 9/20* (2013.01); *F21L 4/08* (2013.01); *A63F 2009/2454* (2013.01); *F21Y 2115/10* (2016.08)

(58) Field of Classification Search
CPC ..... A63F 9/20
See application file for complete search history.

(56) References Cited

U.S. PATENT DOCUMENTS 3,854,725 A 12/1974 Cluck
3,984,109 A 10/1976 Wiles
4,181,304 A * 1/1980 Haber ..... A63F 9/0413 200/61.19
4,641,840 A * 2/1987 Larson ..... A63F 9/04 273/146
6,213,467 B1 4/2001 Andrews
8,662,995 B2 * 3/2014 Hawkins ..... A63F 9/04 463/22
2004/0036213 A1 * 2/2004 Lindsey ..... A63F 9/0468 273/146
2004/0160000 A1 * 8/2004 Lindsey ..... A63F 9/04 273/146
2005/0164778 A1 * 7/2005 Cooney ..... A63F 9/0468 463/22
2006/0119038 A1 6/2006 Crotteau
2009/0015361 A1 * 1/2009 Tremblay ..... A63H 33/046 335/285

(Continued)

FOREIGN PATENT DOCUMENTS

CN 201609586 U * 10/2010
CN 201855563 U * 6/2011

(Continued)

OTHER PUBLICATIONS

Bulkdominoes, "Electro Dominoes", Nov. 16, 2018, https://www.facebook.com/bulkdominoes/videos/vb.759887997361660/930289340508721/?type=2&theater (Year: 2018).*

*Primary Examiner* — Alexander K Garlen

(57) ABSTRACT

An illuminated domino tile assembly for tile-based game play and entertainment includes a plurality of tiles. Each tile comprises a housing that defines an interior space. Each of a set of orifices, which comprises from zero to twelve orifices, is positioned in a first face of the housing and extends to the interior space. Each of a set of discs, which are substantially transparent, is positioned in a respective orifice and is coupled to the housing. A power module and a bulb are coupled to the housing and are positioned in the interior space. The bulb is operationally coupled to the power module so that the power module is positioned to power the bulb. The set of discs is configured to transmit light from the bulb to an area proximate to the housing. The plurality of tiles is configured to play a tile-based game and to provide entertainment.

11 Claims, 3 Drawing Sheets

(56) References Cited

U.S. PATENT DOCUMENTS

| | | | | |
|---|---|---|---|---|
| 2009/0322026 | A1 | 12/2009 | Sun | |
| 2010/0148443 | A1 * | 6/2010 | Hoyt | A63F 3/0415 273/293 |
| 2010/0197148 | A1 * | 8/2010 | Rudisill | H01R 11/30 439/40 |
| 2013/0292905 | A1 | 11/2013 | Bittner | |

FOREIGN PATENT DOCUMENTS

| | | | | |
|---|---|---|---|---|
| CN | 203183659 | U * | 9/2013 | |
| WO | WO-2018167753 | A2 * | 9/2018 | A63F 9/1208 |

* cited by examiner

ILLUMINATED DOMINO TILE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relate to domino tile assemblies and more particularly pertain to a new domino tile assembly for tile-based game play and entertainment.

BRIEF SUMMARY OF THE INVENTION

An embodiment of the disclosure meets the needs presented above by generally comprising a plurality of tiles. Each tile comprises a housing that defines an interior space. Each of a set of orifices, which comprises from zero to twelve orifices, is positioned in a first face of the housing and extends to the interior space. Each of a set of discs, which are substantially transparent, is positioned in a respective orifice and is coupled to the housing. A power module and a bulb are coupled to the housing and are positioned in the interior space. The bulb is operationally coupled to the power module so that the power module is positioned to power the bulb. The set of discs is configured to transmit light from the bulb to an area proximate to the housing. The plurality of tiles is configured to play a tile-based game and to provide entertainment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
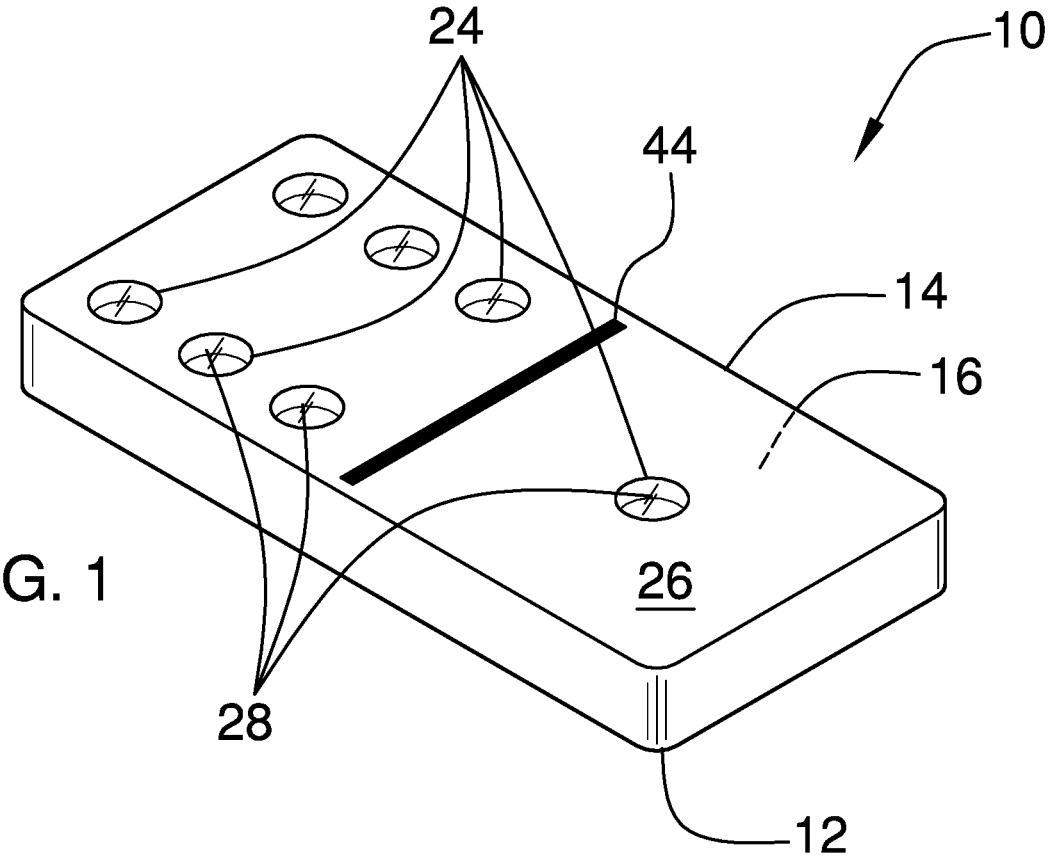
FIG. 1 is an isometric perspective view of an illuminated domino tile assembly according to an embodiment of the disclosure.

With reference now to the drawings, and in particular to FIGS. 1 through 5 thereof, a new domino tile assembly embodying the principles and concepts of an embodiment of the disclosure and generally designated by the reference numeral 10 will be described.

As best illustrated in FIGS. 1 through 5, the illuminated domino tile assembly 10 generally comprises a plurality of tiles 12. Each tile 12 comprises a housing 14 that defines an interior space 16. The housing 14 has a length 18 that measures twice a width 20 of the housing 14. The housing 14 has corner edges 22 that are arcuate. The housing 14 comprises at least one of plastic, wood, metal, glass, and crystal. The housing 14 may comprise at least one of acrylonitrile butadiene styrene, polystyrene, polyoxybenzylmethylenglycolanhydride, and phenol formaldehyde resin.

Figure 3:
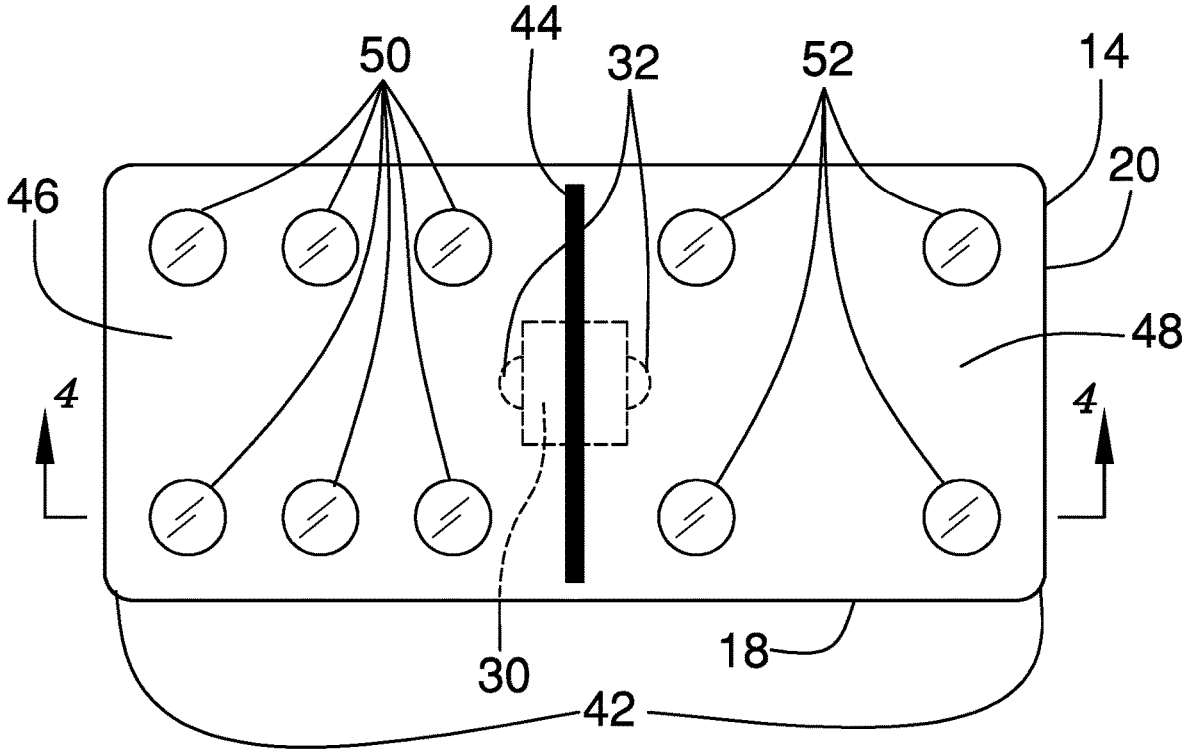
FIG. 3 is a top view of an embodiment of the disclosure.

Each of a set of orifices 24, which comprises from zero to twelve orifices 24, is positioned in a first face 26 of the housing 14 and extends to the interior space 16, as shown in FIG. 3. Each of a set of discs 28, which are substantially transparent, is positioned in a respective orifice 24 and is coupled to the housing 14. The discs 28 comprises at least one of glass and plastic. The discs 28 may comprise at least one of acrylic, polycarbonate, polypropylene, polyethylene, polyethylene terephthalate, polyvinyl chloride, cyclic olefin copolymers, ionomer resin, fluorinated ethylene propylene, styrene methyl methacrylate, styrene-acrylonitrile resin, polystyrene, and methyl methacrylate acrylonitrile butadiene styrene.

Figure 4:
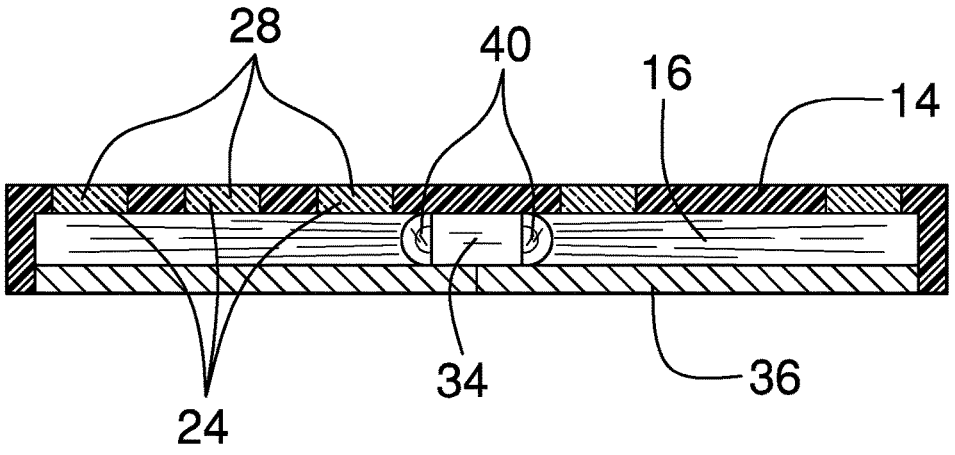
FIG. 4 is a cross-sectional view of an embodiment of the disclosure.
Figure 5:
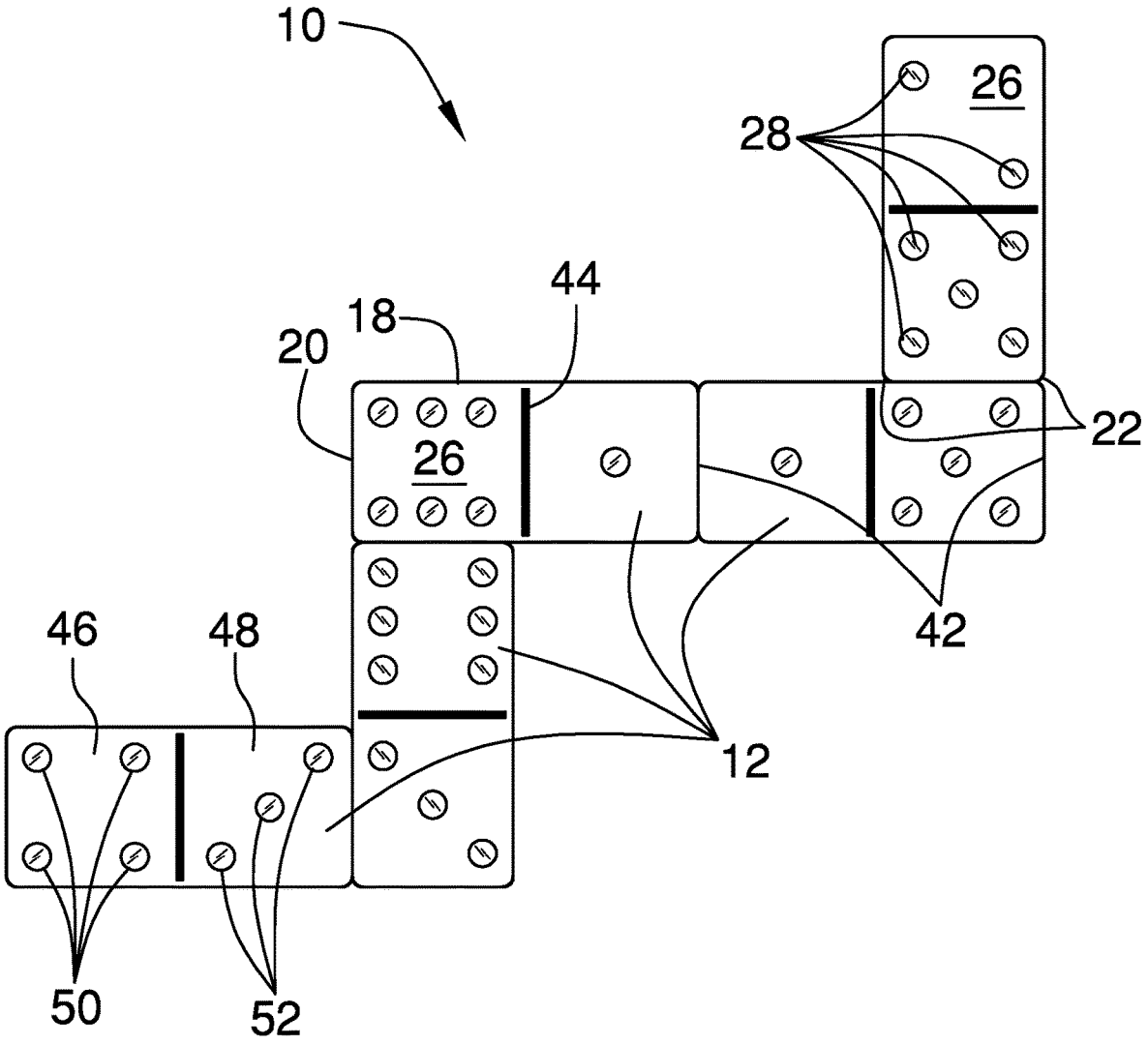
FIG. 5 is an in-use view of an embodiment of the disclosure.

A power module 30 and a bulb 32 are coupled to the housing 14 and are positioned in the interior space 16, as shown in FIG. 4. The bulb 32 is operationally coupled to the power module 30 so that the power module 30 is positioned to power the bulb 32. The set of discs 28 is configured to transmit light from the bulb 32 to an area proximate to the housing 14. The plurality of tiles 12 is configured to play a tile-based game and to provide entertainment. Transmission of light through the set of discs 28 may aid a visually impaired user in playing the tile-based game.

Figure 2:
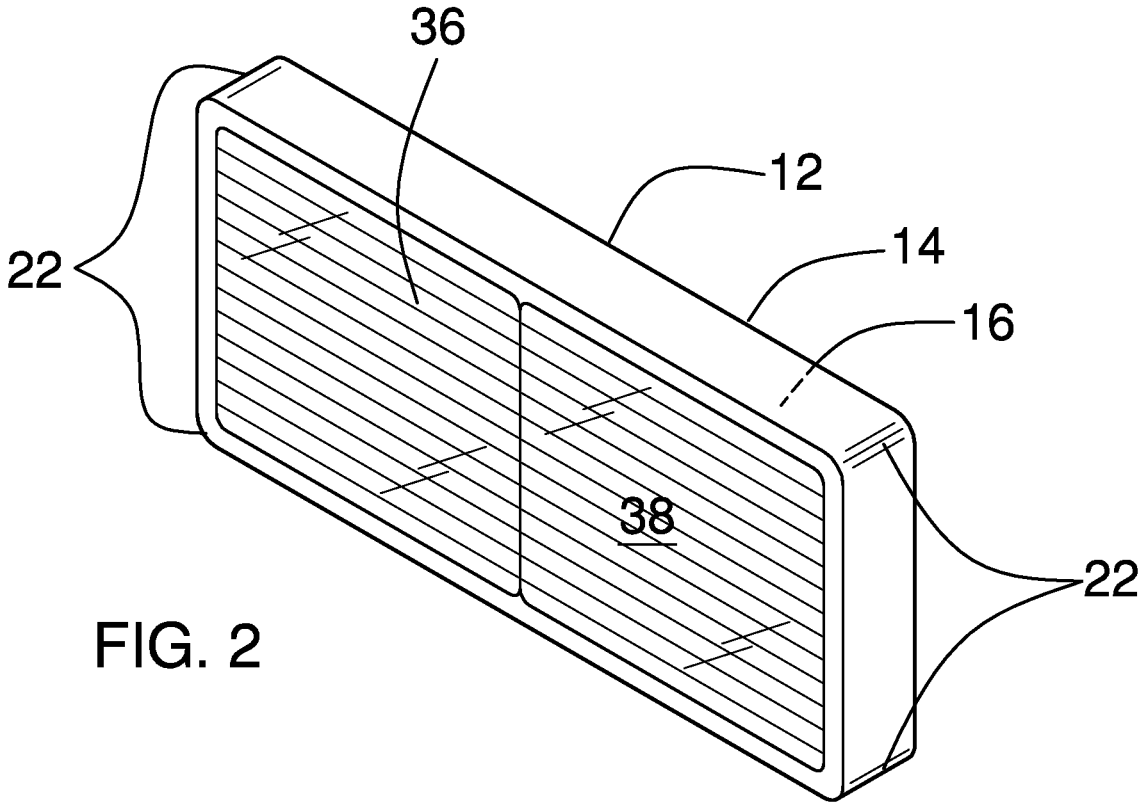
FIG. 2 is an isometric perspective view of an embodiment of the disclosure.

The power module 30 comprises a battery 34, which is rechargeable. A solar panel 36 is coupled to a second face 38 of the housing 14, as shown in FIG. 2. The solar panel 36 is operationally coupled to the battery 34 so that the solar panel 36 is configured to convert photons to an electrical current to charge the battery 34.

The bulb 32 comprises a pair of light emitting diodes 40 that is substantially centrally positioned in the interior space 16. Each light emitting diode 40 faces a respective opposing end 42 of the housing 14. Each light emitting diode 40 emits light of a respective color. Therefore, the tiles 12 of the plurality of tiles 12 may comprise tiles 12 with light emitting diodes 40 that emit a variety of colors of light. Furthermore, a tile 12 may comprise a pair of light emitting diodes 40 that emits two different colors of light.

A line 44 that is coupled to the first face 26 of the housing 14 equally distant from, and parallel to, the opposing ends 42 of the housing 14 defines a first half 46 and a second half 48 of the first face 26 of the housing 14. The set of orifices 24 comprises a set of first holes 50 that is positioned in the first half 46 of the first face 26 of the housing 14 and a set of second holes 52 that is positioned in the second half 48 of the first face 26 of the housing 14. The set of first holes 50 comprises from zero to six first holes 50. The set of second holes 52 comprises from zero to six second holes 52.

In use, the plurality of tiles 12 is used to play tile-based games, such as the many variations of dominos, and to provide entertainment by arranging the plurality of tiles 12 in patterns, with the tiles 12 perpendicular to a substantially horizontal surface, and then toppling the plurality of tiles 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An illuminated domino tile assembly comprising a plurality of tiles, each tile comprising:

a housing defining an interior space;

a set of orifices positioned in a first face of the housing and extending to the interior space, the set of orifices comprising from zero to twelve orifices;

a set of discs, each disc being positioned in a respective orifice and coupled to the housing, the discs being substantially transparent;

a power module coupled to the housing and positioned in the interior space; the power module comprising a battery, the battery being rechargeable; a solar panel coupled to a second face of the housing, the solar panel being operationally coupled to the battery, wherein the solar panel is configured for converting photons to an electrical current for charging the battery; and a bulb coupled to the housing and positioned in the interior space, the bulb being operationally coupled to the power module such that the power module is positioned for powering the bulb wherein the set of discs is configured for transmitting light from the bulb to an area proximate to the housing and wherein the plurality of tiles is configured for playing a tile-based game and to provide entertainment.

2. The assembly of claim 1, further including the housing having a length and a width, the length measuring twice the width.

3. The assembly of claim 1, further including the housing having corner edges, the corner edges being arcuate.

4. The assembly of claim 1, further including the housing comprising at least one of plastic, wood, metal, glass, and crystal.

5. The assembly of claim 4, further including the housing comprising at least one of acrylonitrile butadiene styrene, polystyrene, polyoxybenzylmethylenglycolanhydride, and phenol formaldehyde resin.

6. The assembly of claim 1, further including the discs comprising at least one of glass and plastic.

7. The assembly of claim 6, further including the discs comprising at least one of acrylic, polycarbonate, polypropylene, polyethylene, polyethylene terephthalate, polyvinyl chloride, cyclic olefin copolymers, ionomer resin, fluorinated ethylene propylene, styrene methyl methacrylate, styrene-acrylonitrile resin, polystyrene, and methyl methacrylate acrylonitrile butadiene styrene.

8. The assembly of claim 1, further including the bulb comprising a pair of light emitting diodes substantially centrally positioned in the interior space, each light emitting diode facing a respective opposing end of the housing.

9. The assembly of claim 8, further including each light emitting diode emitting light of a respective color.

10. The assembly of claim 1, further including a line coupled to the first face of the housing equally distant from and parallel to the opposing ends of the housing defining a first half and a second half of the first face of the housing, the set of orifices comprising a set of first holes positioned in the first half of the first face of the housing and a set of second holes positioned in the second half of the first face of the housing, the set of first holes comprising from zero to six first holes, the set of second holes comprising from zero to six second holes.

11. An illuminated domino tile assembly comprising a plurality of tiles, each tile comprising:

a housing defining an interior space, the housing having a length and a width, the length measuring twice the width, the housing having corner edges, the corner edges being arcuate, the housing comprising at least one of plastic, wood, metal, glass, and crystal, the housing comprising at least one of acrylonitrile butadiene styrene, polystyrene, polyoxybenzylmethylenglycolanhydride, and phenol formaldehyde resin;

a set of orifices positioned in a first face of the housing and extending to the interior space, the set of orifices comprising from zero to twelve orifices;

a set of discs, each disc being positioned in a respective orifice and coupled to the housing, the discs being substantially transparent, the discs comprising at least one of glass and plastic, the discs comprising at least one of acrylic, polycarbonate, polypropylene, polyethylene, polyethylene terephthalate, polyvinyl chloride, cyclic olefin copolymers, ionomer resin, fluorinated ethylene propylene, styrene methyl methacrylate, styrene-acrylonitrile resin, polystyrene, and methyl methacrylate acrylonitrile butadiene styrene;

a power module coupled to the housing and positioned in the interior space, the power module comprising a battery, the battery being rechargeable;

a solar panel coupled to a second face of the housing, the solar panel being operationally coupled to the battery wherein the solar panel is configured for converting photons to an electrical current for charging the battery;

a bulb coupled to the housing and positioned in the interior space, the bulb being operationally coupled to the power module such that the power module is positioned for powering the bulb wherein the set of discs is configured for transmitting light from the bulb to an area proximate to the housing and wherein the plurality of tiles is configured for playing a tile-based game and to provide entertainment, the bulb comprising a pair of light emitting diodes substantially centrally positioned in the interior space, each light emitting diode facing a respective opposing end of the housing, each light emitting diode emitting light of a respective color; and a line coupled to the first face of the housing equally distant from and parallel to the opposing ends of the housing defining a first half and a second half of the first face of the housing, the set of orifices comprising a set of first holes positioned in the first half of the first face of the housing and a set of second holes positioned in the second half of the first face of the housing, the set of first holes comprising from zero to six first holes, the set of second holes comprising from zero to six second holes.

* * * * *